United States Patent [19]

Opp et al.

[11] Patent Number: 4,893,447

[45] Date of Patent: Jan. 16, 1990

[54] CYCLORAMA CONSTRUCTION

[76] Inventors: Ronald E. Opp, 12122 SW. Tualitan La., Beaverton, Oreg. 97005; Frederick W. von Tagen, 1102 Schaeffer Rd., West Linn, Oreg. 97068

[21] Appl. No.: 150,839

[22] Filed: Feb. 1, 1988

[51] Int. Cl.[4] ..... E04B 1/32

[52] U.S. Cl. ..... 52/288; 52/80

[58] Field of Search ..... 52/80, 288, 290; D25/18, 19

[56] References Cited

U.S. PATENT DOCUMENTS

| | | | |
|---|---|---|---|
| 2,114,044 | 4/1938 | Bonnell | 52/288 |
| 2,307,338 | 1/1943 | Shiyter et al. | 52/288 |
| 2,921,352 | 1/1960 | Pfeifle | 52/288 |
| 3,284,969 | 11/1966 | Walters et al. | 52/80 |
| 3,562,975 | 2/1971 | Moss | 52/80 |
| 3,763,608 | 10/1973 | Chamlee | 52/80 |
| 3,807,101 | 4/1974 | Cole | D25/18 |
| 3,921,555 | 11/1975 | Suzuki et al. | 52/80 |
| 4,023,317 | 5/1977 | Bettger et al. | 52/80 |
| 4,068,421 | 1/1978 | Marovich | 52/80 |
| 4,296,869 | 10/1981 | Jawad | 52/80 |
| 4,655,013 | 4/1987 | Ritland | 52/80 |

FOREIGN PATENT DOCUMENTS

| | | | |
|---|---|---|---|
| 587690 | 11/1959 | Canada | D25/19 |
| 661025 | 11/1951 | United Kingdom | 52/288 |
| 2031478 | 4/1980 | United Kingdom | 52/288 |

OTHER PUBLICATIONS

Architectural Design Citation; (Ungers and Kiss) Progressive Architecture (pp. 16–18), Jan. 1983.

Pp. 46, 48, 50, 52 and 54—Oct. 1988 edition of the magazine "Photo District News".

*Primary Examiner*—Michael Safavi

*Attorney, Agent, or Firm*—James D. Givnan, Jr.

[57] ABSTRACT

A cyclorama utilizing floor and ceiling coves of concavo-convex shape having side flanges receiving fasteners for assembly of the coves along a studio floor and ceiling. Recessed side marginal areas of the coves receive cementious material to provide an uninterrupted surface which conceals the joint area between abutting coves. The floor cove includes a lower edge of increased thickness to accommodate a fillet. Floor and ceiling corner coves are each curved along two axes for installation at the intersection of cyclorama wall components. The corner coves include converging side flanges for attachment to the side flanges of the floor and ceiling coves.

1 Claim, 1 Drawing Sheet

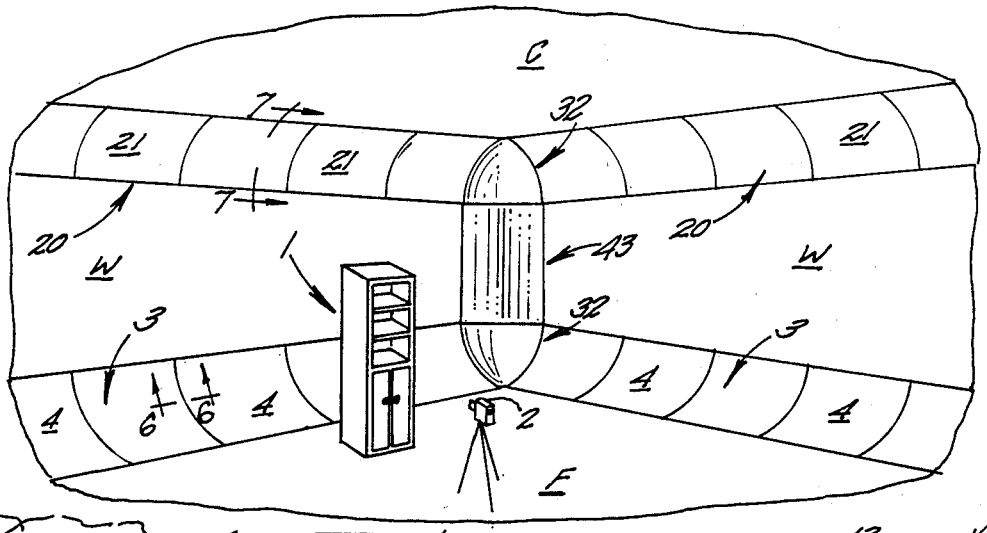
FIG. 1
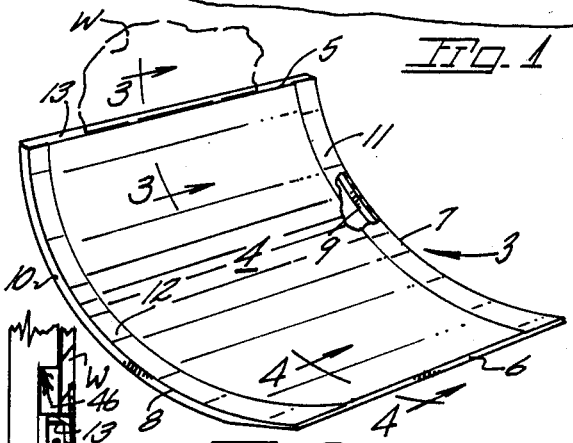
FIG. 2
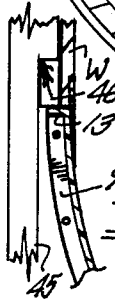
FIG. 3
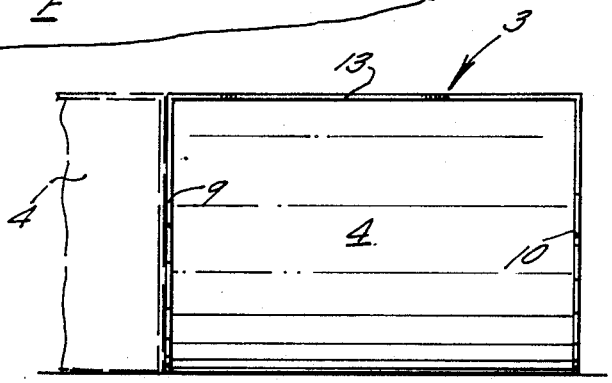
FIG. 5
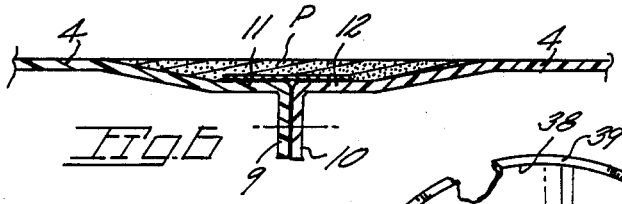
FIG. 6
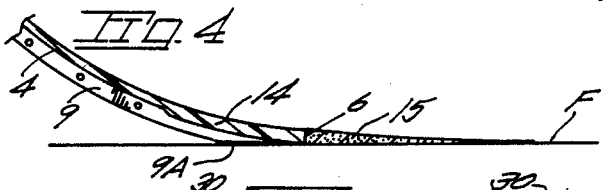
FIG. 4
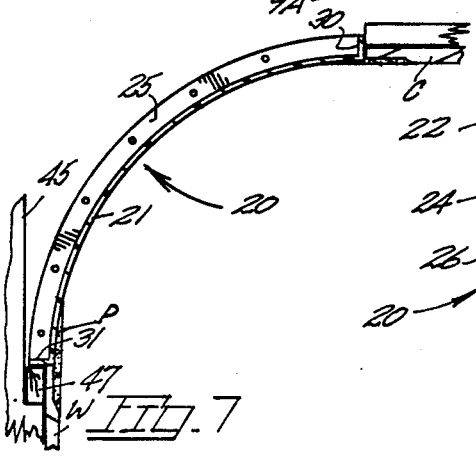
FIG. 7
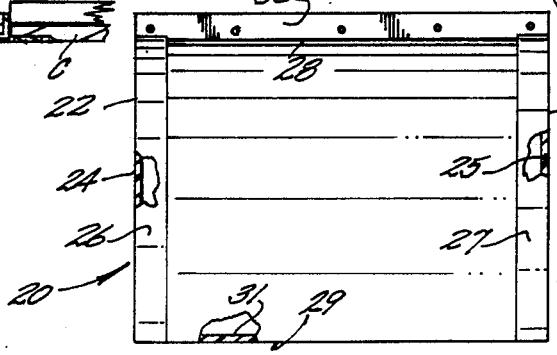
FIG. 8
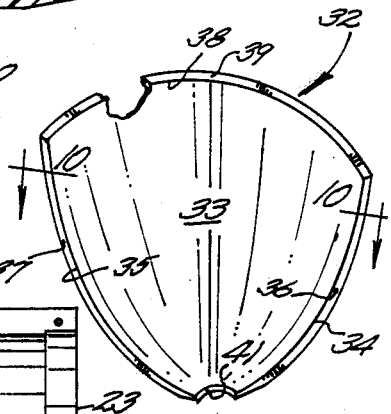
FIG. 9
FIG. 10
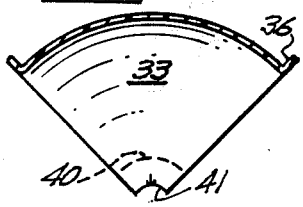

CYCLORAMA CONSTRUCTION

BACKGROUND OF THE INVENTION

The present invention pertains generally to cycloramas used in the fields of photography and video to provide a horizon-less backdrop for the images being produced.

By definition, a cyclorama is a structure used as a background to provide the appearance of unlimited space by having no horizon or wall intersections. In the past, cyclorama structures to our knowledge have been built in situ in a permanent manner integral with a building wall and floor and using conventional building components. Accordingly, the cyclorama is costly to construct and not intended to be relocated. Further, such known construction is susceptible to damage by personnel working about the structure during a filming effort particularly the lowermost cove portions of a cyclorama.

SUMMARY OF THE PRESENT INVENTION

The present invention is embodied in a cyclorama that is comprised of molded cove sections for use adjacent the floor and ceiling of a studio or other site.

The cove sections are provided with side flanges to facilitate section securement to adjacent cove sections. Additionally the cove sections have recessed side marginal areas to permit the use of plaster or the like to conceal the juncture between abutting coves to render same invisible in the background of a photo or video taped image. Provision is also made enabling offsetting a cove edge from ceiling or wall structure of the cyclorama to permit additional use of plaster for concealing abutting edges and rendering an uninterrupted surface. The cyclorama corners utilize upper and lower corner coves curved along two axes to provide curved intersections at corners between floor coves and between ceiling coves which are curved along a single axis. The corner coves have convergent side edges which terminate at an apex formed on a radius.

Important objectives of the present cyclorama include the provision of such a structure made up of but a few cove designs to permit low cost manufacture and assembly of a cyclorama without costly alteration of building construction; the provision of a cyclorama the components which may be utilized as modules to provide a cyclorama of any size desired and one which may be readily modified to suit space and photographic criteria; the provision of a cyclorama having components which may be readily located and assembled by one person using simple hand tools; the provision of a cyclorama having coves with recessed marginal areas to support cementious material which conceals the abutting edges of adjacent coves.

BRIEF DESCRIPTION OF THE DRAWINGS

In the accompanying drawings:

FIG. 1 is a perspective view of the present cyclorama with the cove sections shown outlined for purposes of illustration only;

FIG. 2 is a perspective view of a floor-to-wall or floor cove with fragments broken away for purposes of illustration;

FIG. 3 is a sectional view taken along line 3—3 of FIG. 2;

FIG. 4 is a sectional view taken along line 4—4 of FIG. 2 and with fillet and floor details added;

FIG. 5 a rear elevational view of the floor cove shown in FIG. 2;

FIG. 6 is a sectional view taken along line 6—6 of FIG. 1 and showing abutting side flanges and overlying material;

FIG. 7 is a sectional view taken along line 7—7 of FIG. 1 and showing a ceiling cove;

FIG. 8 is a front elevational view of the ceiling cove shown in FIG. 7 but removed from supporting structure;

FIG. 9 is a perspective view of a corner cove; and

FIG. 10 is a horizontal sectional view taken along line 10—10 of FIG. 9.

DETAILED DESCRIPTION OF THE PREFERRED EMBODIMENTS

With continuing attention to the drawings wherein applied reference numerals indicate parts similarly hereinafter identified, the reference numeral 1 indicates a subject being photographed or video taped or otherwise reduced to an image by use of a camera at 2. A floor is at F and a ceiling is at C.

Cycloramas, as earlier noted, serve to provide a background or backdrop for the subject being photographed which appears in the photo or other image rendered as an uninterrupted expanse. A lower or floor cove of the present cyclorama is indicated generally at 3 and is comprised of a molded curved sheet 4, preferably of resin reinforced with fiberglass, and having an upper edge 5 and a lower edge 6 parallel to one another. Side edges at 7 and 8 are curved through approximately a 90 degree arcs. Side flanges are indicated at 9 and 10 each being integral with a side edge. Contiguous with the side edges are recessed curved side margins 11 and 12 as best shown in FIG. 6 which receive a quantity of cementious material P. Floor cove 3 includes an upper flange 13 integral with cove upper edge 5. With attention to FIG. 4, sheet 4 is of increased section at 14 along its lower margin which terminates in lower edge 6. The increased section or thickness of lower portion 14 serves to reinforce the sheet adjacent a floor surface at F and also enables the use of a fillet 15 to continue the cove arc for mergence with the floor surface. Edge 6 rests on floor surface F by reason of side flanges 9 and 10 being beveled at 9A and extending rearwardly from edge 6.

The side flanges, as well as upper flange 13, define spaced apart apertures to receive fasteners joining the floor cove side flanges of adjacent coves and the upper edge flange of the cove to a supporting structure such as wall structure at W.

A ceiling cove is indicated generally at 20 and includes a curved sheet 21 having side edges 22 and 23 provided with curved side flanges 24 and 25. In similarity to the floor cove, the ceiling cove is provided with recessed curved marginal side areas at 26 and 27 to receive material overlying the marginal areas and the abutting side edges of adjacent ceiling coves to conceal said edge. Upper and lower flanges 30 and 31 are integral with upper and lower edges 28 and 29 of the ceiling cove.

A corner cove structure generally at 32 utilizes upper and lower coves of substantially identical construction curved along two axes through 90 degrees. As the upper and lower corner coves almost identical, the following description of one is believed sufficient. The lower corner cove 32 includes a molded sheet 33, preferably of fiberglass, having curved side edges at 34 and 35 integral with which are side flanges 36 and 37. A horizontal edge 38 carries a horizontal flange 39. The bottom apex of a lower cove is in the shape of an edge formed at 41 on a radius of about four inches or so and is of a thickness at 40 greater than the remainder of the cove to receive an anchoring or fastening device. The flanges 36, 376 and 39 are apertured at intervals to receive fasteners.

An upright corner cove is indicated generally at 43 and may be ceiling cove 20 rotated through 90 degrees so as to reorientate same to the vertical whereat its side flanges 24 and 25 will abut the horizontal flanges 39 of the upper and lower corner coves. Upon such reorientation, the flanges 30 and 31 of the ceiling cove will each abut wall structure W.

In a typical cyclorama installation, the wall components W would be wallboard or the like supported by wall studs 45. A horizontal stringer 46 provides a horizontal surface on its underside to which is attached the upper flange 13 of each floor cove. Ceiling coves 20 are attached to the wall components in a similar fashion with a second stringer at 47 serving to receive flange 31 of said ceiling coves. To provide an uninterrupted surface between the wall component W and the floor and ceiling coves, the latter are offset somewhat inwardly from the surface of the wall component to permit a quantity of plaster or the like to conceal the interface between cove and wall component. Desirably the wall component may be slightly recessed along its upper and lower edges to receive the plaster and provide a smooth surface. With attention to the floor and ceiling corner coves 33, the interface or joints between the side flanges of the corner coves and the side flanges of the floor and ceiling coves are concealed by the application of plaster or the like which occupies the side marginal areas 11–12 and 26–27 of the floor and ceiling coves and extends over the joint and merges with the curved surface of the floor and ceiling corner coves in a featheredged manner. Accordingly, the surface of the cyclorama is characterized by being continuous without irregularities or interruption which would cause shadows to appear to destroy the desired image of infinity behind the subject being photographed or filmed.

While FIG. 1 shows the cove components visible, it will be understood that all joints in the cyclorama will be concealed.

The lower corner coves 32 by reason of being of increased thickness at 40, as well as lower portion 14 of lower coves 3, permit anchoring devices to be recessed therein.

The floor and ceiling coves may be used independently, that is, a series of lower coves alone or lower and upper coves with corner coves at the intersection of wall components depending on the size of the cyclorama.

While we have shown but a few embodiments of the invention, it will be apparent to those skilled in the art that the invention may be embodied still otherwise without departing from the spirit and scope of the invention.

Having thus described the invention, what is desired to be secured by a Letters Patent is:

We claim:

1. Coves for linear abutting installation between horizontal and vertical supports to provide curved surfaces therebetween, each of said coves comprising, a curved sheet of concavo-convex shape having an upper edge and a lower edge parallel to one another and curved side edges, said sheet having a lower portion of increased thickness to support momentary loads applied thereto and to receive a cove anchoring device in a recessed and concealed manner, side flanges integral with the sheet along the curved side edges thereof, said side flanges adapted for abutment with and attachment to the side flanges of adjacent coves, said side flanges being truncated so as to terminate rearwardly from said lower edge of the sheet to permit said lower edge to rest on and be supported by the horizontal support, at least one of the parallel edges having a flange therealong for securement to one of said supports, and said curved sheet having concave recessed marginal areas contiguous with and extending the length of said curved side edges, said marginal areas of the sheet are for the reception of deposited cementious material so that the material will overlie abutting curved side edges of adjacent coves to conceal same.

* * * * *